United States Patent [19]

Bateman

[11] 4,365,150

[45] Dec. 21, 1982

[54] GAIN STABILIZED MICROCHANNEL PLATES AND MCP TREATMENT METHOD

[75] Inventor: Roger S. Bateman, Beaverton, Oreg.

[73] Assignee: Tektronix, Inc., Beaverton, Oreg.

[21] Appl. No.: 208,910

[22] Filed: Nov. 21, 1980

Related U.S. Application Data

[63] Continuation of Ser. No. 904,058, May 8, 1978, abandoned.

[51] Int. Cl.[3] ..... H01J 43/04

[52] U.S. Cl. ..... 250/207; 250/213 VT; 428/36; 428/188; 428/432; 428/913

[58] Field of Search ..... 313/105 CM, 103 CM; 428/471, 36, 432, 188, 702, 913; 427/77, 106; 250/207, 213 VT; 316/5-9; 65/30.1, 30.13, 30.14, 60.5, 60.51, 60.52, 60.53

[56] References Cited

U.S. PATENT DOCUMENTS

| | | | |
|---|---|---|---|
| 3,628,933 | 12/1971 | Kramer | 427/77 |
| 4,002,735 | 1/1977 | McDonie | 427/78 |
| 4,051,403 | 4/1977 | Feingold et al. | 313/105 CM |
| 4,073,989 | 2/1978 | Wainer | 428/131 |
| 4,096,381 | 6/1978 | Brown, Sr. | 250/213 VT |

FOREIGN PATENT DOCUMENTS

| | | | |
|---|---|---|---|
| 1117224 | 3/1959 | Fed. Rep. of Germany . | |
| 2121515 | 3/1970 | Fed. Rep. of Germany . | |
| 294532 | 4/1965 | Netherlands . | |
| 1023655 | 3/1966 | United Kingdom . | |
| 1137910 | 12/1968 | United Kingdom . | |
| 1413552 | 11/1975 | United Kingdom . | |
| 171935 | 8/1965 | U.S.S.R. . | |
| 621037 | 8/1978 | U.S.S.R. | 316/5 |

*Primary Examiner*—Stanley S. Silverman
*Attorney, Agent, or Firm*—John D. Winkelman

[57] ABSTRACT

Microchannel plates having increased gain and significantly improved aging characteristics are provided by forming a thin film of a cesium compound on the channel walls. In an exemplary embodiment, a surface film of cesium hydroxide is applied to the interior wall surfaces of an MCP by saturating the plate with a solution of the compound, then allowing the solvent to evaporate. The cesium hydroxide residue on the walls subsequently is converted to cesium oxide by a high temperature bake.

3 Claims, 2 Drawing Figures

GAIN STABILIZED MICROCHANNEL PLATES AND MCP TREATMENT METHOD

CROSS-REFERENCE TO RELATED APPLICATIONS

This is a continuation of application Ser. No. 904,058, filed May 8, 1978 now abandoned.

BACKGROUND OF THE INVENTION

The present invention is concerned with improving the gain stability of microchannel plate (MCP) electron multipliers.

Microchannel plates are increasingly being used in image intensifiers, radiation detectors, CRT display systems, and other applications because of the unique combination of properties they possess. These include high operating gain, low noise, high spatial resolution, and large active areas coupled with compact size.

A microchannel plate (MCP), also known as a channel-electron multiplier array (CEMA), consists of a parallel array of individual electron multiplier channels of microscopic diameter. MCP's are usually made of glass as a polygonal or round disk about 20 to 50 mm in diameter and about 0.6 to 4 mm thick. Channel diameters typically are in the range of about 12 to 100 microns. Various methods are used to manufacture microchannel plates, the most widely used of which are based on glass fiber drawing techniques similar to those used to make fiber optic plates. A detailed description of channel plate manufacturing technology may be found in *Acta Electronica,* Vol. 14, No. 2 (1971) at pages 201-224. Briefly, however, a suitable matrix glass is first drawn into tubular fibers, which either may be hollow or may contain a metal or soluble glass core. Lengths of the fiber are formed into a parallel bundle, then fused together by applying pressure to the bundle and heating it to a temperature of about 500°-600° C. Channel plates are made by cutting the fused bundle into slices and polishing the faces of each slice. If the bundles are formed using cored fibers, the cores are dissolved out with an etchant at this point in the procedure. The hollow channels are next treated to obtain the necessary electrical conductance and secondary emission properties required for channel electron multiplication. Finally, metal electrodes are applied to both faces of the plate by vacuum deposition.

MCP's with channel diameters smaller than about 40 microns are produced by a double draw method similar to the process just described, except that thicker fibers are used initially. Long, narrow bundles are assembled and fused together, typically in a hexagonal array. The fused bundles are then drawn a second time to produce multifiber units in which each channel is of the required final size. Finally, after the hexagonal multifiber is cut into lengths, packed into bundles and fused together, channel plates are made from the fused bundle in the manner already described.

A microchannel plate is operated in a vacuum with different potentials applied to the electrodes to produce an axial electric field through the channels. When radiation in the form of electrons, photons, x-rays, etc. enters the low potential end of a channel and strikes the inner surface with sufficient energy, electrons are emitted from the surface. (The channel typically are tilted or curved a few degrees from normal to prevent radiation from passing straight through.) The emitted electrons collide with the walls repeatedly as they are accelerated toward the output end of the channel by the applied electric field, producing additional secondaries. Ultimately, very large numbers of electrons produced by such multiplication are emitted from the high potential end of the channel.

The gain of a channel multiplier depends on its length-to-diameter ratio, on the magnitude of the applied potentials, and on the secondary emission characteristics of the semiconducting inner wall surface. While larger diameter, single channel electron multipliers of the Channeltron type have a long period of stable gain in operation, this characteristic has not been shared by microchannel plates. Gain degradations of one to two orders of magnitude have been reported, for example, by Sandel et al., *Applied Optics,* Vol. 16, No. 5 (May, 1977) and Authinarayanan et al., *Advances in Electronics and Electron Physics,* Vol. 40A pp. 167-181. Academic Press (1976).

The glass commonly used to make MCP's (e.g. Corning 8161) is basically a potash lead glass, which is a good insulator. The necessary electrical conductance and secondary emission properties are developed by heating the channel plates in hydrogen to produce a very thin semiconducting surface film on the channel walls. The mechanism of secondary emission from the glass channel walls is not well understood. It has been shown, however, that potassium is present on the secondary emission surfaces in disproportionately large quantities, and that its concentration affects secondary electron yield. For example, see Siddiqui, *J. Appl. Optics* Volt. 48, No. 7 (July, 1977) and Hill, *Advances in Electronics and Electron Physics,* Vol. 40A, pp. 153-165, Academic Press (1976). A decrease in channel surface potassium concentration has been found to result from prolonged electron bombardment, and suggested as a possible cause of MCP gain degradation.

SUMMARY OF THE INVENTION

The present invention provides microchannel plates having increased gain and very significantly improved aging characteristics compared to prior art MCP's. These benefits are achieved by forming a thin film of a cesium compound on the channel walls in accordance with the invention. In an illustrated embodiment, a surface film of cesium hydroxide is applied to the channel walls of an MCP by saturating the porous plate with a diluate alcoholic solution of the compound, then allowing the solvent to evaporate. The CsOH residue coating the walls is subsequently converted to cesium oxide by a high temperature bake. Alternatively, cesium may be incorporated into the glass from which the microchannel plate is manufactured.

DETAILED DESCRIPTION OF THE INVENTION

Figure 1:
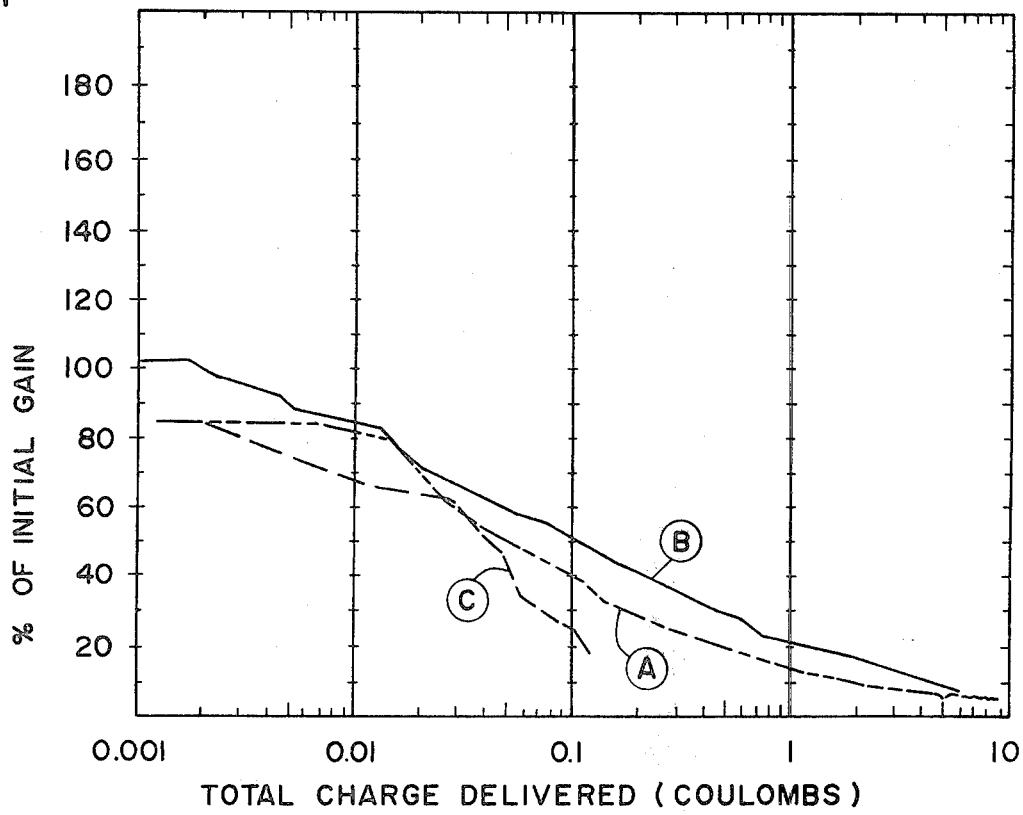
FIG. 1 graphically depicts the aging rate of a conventional microchannel plate in three different operational modes.

The inclusion of a thin cesium-containing layer or region in the secondary emission surfaces of a microchannel plate to improve its gain stability is based on a hypothesis that cesium ions will tend to remain at the wall surfaces during electron bombardment rather than migrate away from the surface region as potassium ions have been shown to do. This is believed to be the result of cesium's larger ionic radius and lower specific surface energy.

The formation of a cesium-containing film in the channels of an MCP suitably is carried out in accordance with a preferred embodiment of the invention by infusing the plate's channels with a solution of a cesium compound, then evaporating off the solvent to leave a residue of the compound on the channel wall surfaces. The solution preferably is one that will not attack or react with the glass wall surfaces in a deleterious manner. Dilute (0.01 to 0.1 M) alcohol/water solutions of a cesium compound, e.g. cesium hydroxide, are suitable. Good results have been achieved using 0.01–0.05 M CsOH 80% isopropanol/20% water solutions, with the infused plates being allowed to dry at room temperature. After evaporation of the solvent, a thin, relatively uniform residue of the cesium compound coats the entire length of each channel's walls. If the cesium compound deposited on the wall surfaces is one that is not stable under operating conditions, it may be converted to a stable form by, for example, subjecting the plate to a high temperature bake.

The solution evaporation application method has a number of advantages, including simplicity and low cost. In addition, it may be used to treat conventional, commercially-available microchannel plates to achieve increased initial gain and significantly improved gain stability. The terms "gain stability" and "aging rate" as used herein refer to changes in the gain of an MCP as a function of total delivered charge.

Results equivalent to that of the solution evaporation method can be achieved by incorporating the cesium in the raw glass used to fabricate the microchannel plate, suitably as a replacement for a portion of the potassium content.

The following example will illustrate the advantages provided by the present invention. One half the active area of a 80×100 mm microchannel plate manufactured by Galileo Electro-Optics Corporation is saturated with a 0.05 M isopropanol/water solution of CsOH and allowed to dry at room temperature. The other half is left untreated. The MCP is about 1 mm thick and includes a hexagonal array of channels, each about 25 microns in diameter. The channels are inclined about 19° relative to the faces of the plate. After drying, the MCP is built into a cathode ray tube, mounted parallel with and about 3 mm from the CRT's phosphor display screen. During its manufacture the tube is subjected to a 320°–350° C. bake, which converts the CsOH in the treated channels of the MCP to cesium oxide.

The assembled microchannel plate CRT is mounted in a special life test rack and operated with a 1000 V potential across the MCP. For the purpose of determining the effect of the cesium treatment, the tube's electron beam is swept sequentially in a raster pattern over three different 18×72 mm zones on the microchannel plate's input face. The beam's sweep rate is varied so that each zone is aged while operating in a different mode—one (A) heavily saturated, one (B) partially saturated, and one (C) unsaturated. The three zones and a fourth, comparison zone that is not addressed by the beam each lie half in the treated and half in the untreated area of the plate.

Figure 2:
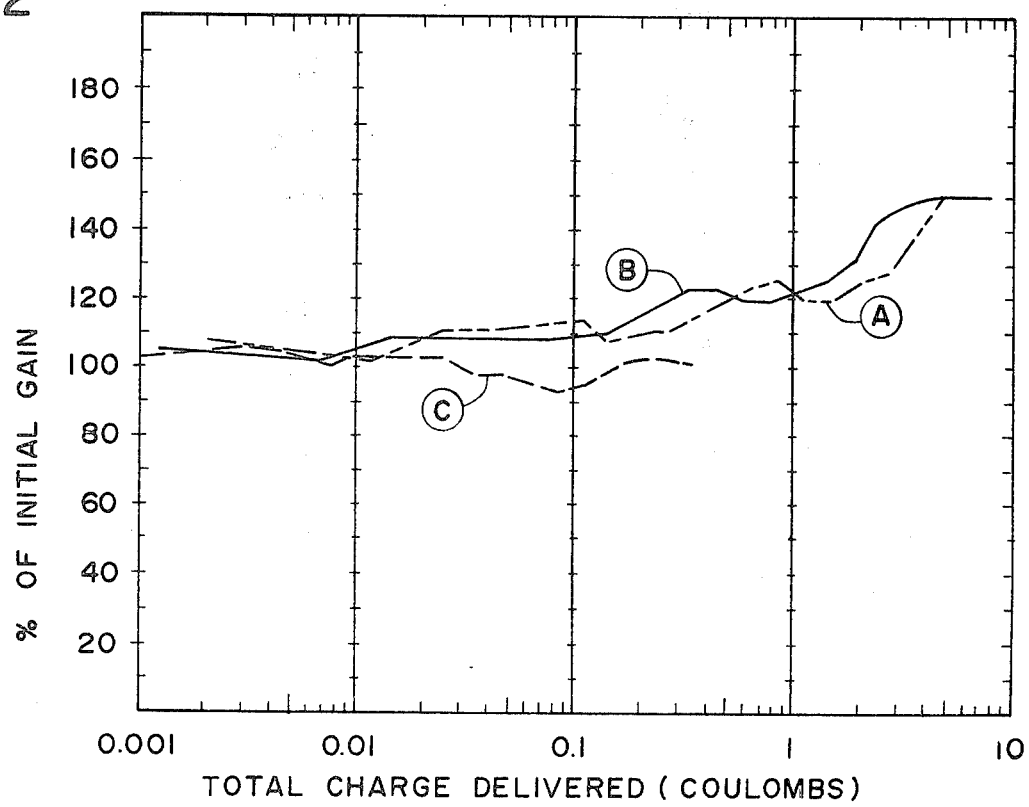
FIG. 2 depicts the aging rate of an MCP having a thin film of a cesium compound on the channel walls.

Gain measurements are made in all four zones periodically during aging of the tube. For comparison purposes the measurements are made in the unsaturated mode of operation. The initial gain of the cesium-treated area of the plate is 50 to 60% higher than that of the untreated area. FIG. 1 is a plot of gain (as a % of initial) versus the total charge delivered (in coulombs per test area) for the untreated areas of the MCP. FIG. 2 is a similar plot for the treated areas. As can be seen, the long term gain stability of the microchannel plate is very significantly improved by the cesium treatment of the invention.

While the best mode presently contemplated for practicing the invention has been set forth, it will be appreciated that various changes and modifications are possible in addition to those specifically mentioned. The appended claims are thus intended to cover all such variations and modifications as come within the true, legitimate scope of the invention.

I claim:

1. In a microchannel plate comprising a multiplicity of elongate tubular channels formed of a lead-containing glass, each such channel including a secondary electron-emissive interior wall surface region, the improvement comprising the inclusion of cesium oxide in said region in an amount sufficient to increase the gain and improve the aging rate of said plate.

2. A microchannel plate comprising a multiplicity of elongate hollow channels formed of lead-containing glass, each of said channels including a secondary electron-emissive interior wall surface region, characterized in that a stable cesium oxide is incorporated into said surface regions in an amount sufficient to stabilize the gain characteristics of said channels.

3. The microchannel plate of claim 2, further characterized in that the regions incorporating said cesium compound extend substantially the entire length of said channels.

* * * * *